United States Patent [19]

Yamazaki et al.

[11] Patent Number: 4,880,223

[45] Date of Patent: Nov. 14, 1989

[54] SORTER HAVING A MECHANISM FOR DRIVING BINS STEPWISE

[75] Inventors: Hideo Yamazaki, Tokyo; Kazunori Kubota, Yokohama, both of Japan

[73] Assignee: Ricoh Company, Ltd., Tokyo, Japan

[21] Appl. No.: 287,554

[22] Filed: Dec. 20, 1988

Related U.S. Application Data

[63] Continuation of Ser. No. 55,348, May 29, 1987, abandoned.

[30] Foreign Application Priority Data

May 31, 1986 [JP] Japan ..... 61-126720

[51] Int. Cl.[4] ..... B65H 39/10

[52] U.S. Cl. ..... 271/293; 271/294; 271/288; 188/159

[58] Field of Search ..... 271/292, 293, 294, 272–274, 271/288; 188/159

[56] References Cited

U.S. PATENT DOCUMENTS

| | | | |
|---|---|---|---|
| 4,332,377 | 6/1982 | DuBois et al. | 271/294 |
| 4,500,087 | 2/1985 | DuBois | 271/294 |
| 4,688,786 | 8/1987 | Takahata | 271/288 |

FOREIGN PATENT DOCUMENTS

| | | | |
|---|---|---|---|
| 60-112568 | 6/1985 | Japan | 271/293 |
| 61-023082 | 1/1986 | Japan | 271/293 |
| 573385 | 9/1977 | U.S.S.R. | 188/159 |

*Primary Examiner*—H. Grant Skaggs

*Attorney, Agent, or Firm*—Oblon, Spivak, McClelland, Maier & Neustadt

[57] ABSTRACT

A sorter in which a stepwise bin driving mechanism which includes helical cams moves bins, which are arranged in multiple steps, sequentially and intermittently to a sheet delivery position for loading the respective bins with sheets. The sorter includes pin guides and support frames which are constituted by side plates each being provided with an elongate slot for guiding a pin, which is provided on each side of the base end of a bottom plate of each bin. Cam members are provided at both sides of the other or free end of each bin. The cam members of the lowermost one of the bins have a greater height than those of the other bins so that, while the sorter is in a sort mode, the space available above the bottom plate of the lowermost bin for receiving sheets becomes greater than those available above the other bins. A bin drive motor which serves as a drive source for the bin driving mehanism is implemented with an AC reversible motor. A motor stop control circuit is associated with the reversible motor for rectifying AC current to apply braking current to the reversible motor. A mechanism for transporting a sheet to the delivery position includes drive and driven rollers which constitute a transport roller pair. Each of the drive rollers is provided at one end thereof with a flange which is greater in diameter than that portion of the drive roller which makes contact with its associated driven roller.

6 Claims, 16 Drawing Sheets

Fig. 8B
Fig. 8A
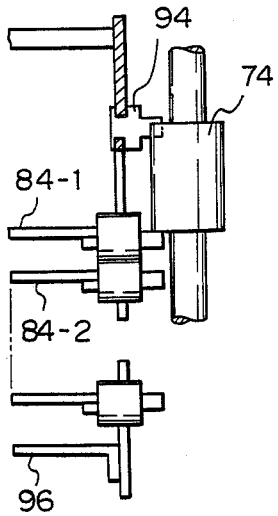
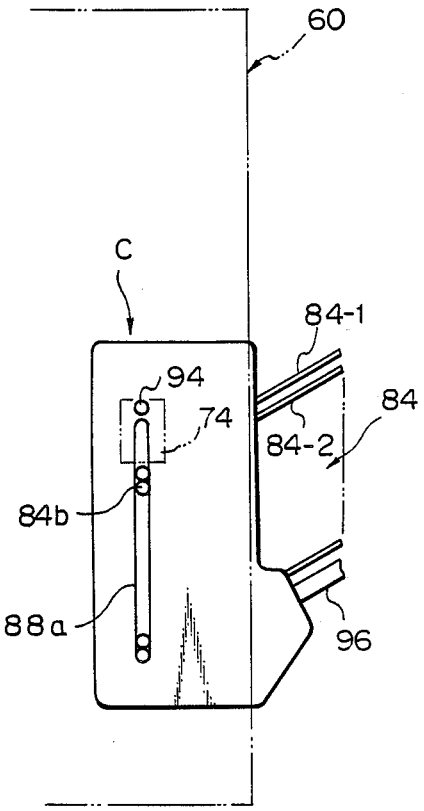

Fig. 10B
Fig. 10A
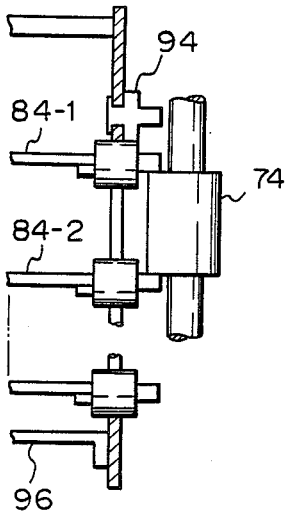
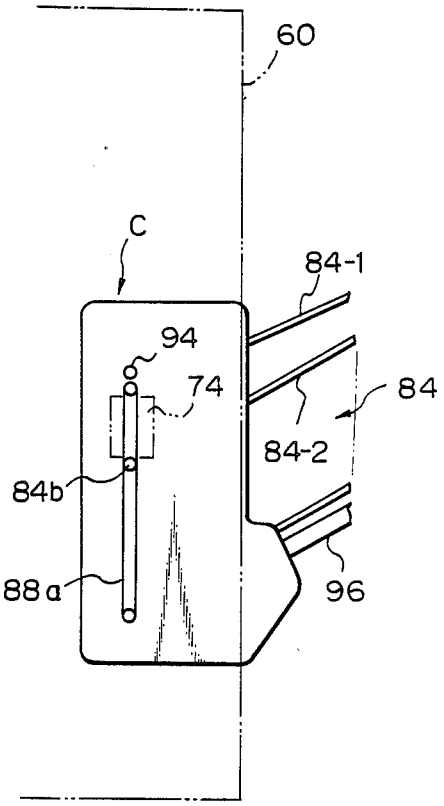

SORTER HAVING A MECHANISM FOR DRIVING BINS STEPWISE

This application is a continuation of application Ser. No. 055,348 filed on May 29, 1987, now abandoned.

BACKGROUND OF THE INVENTION

The present invention relates to a sorter for sorting and collating copy sheets which are sequentially discharged from a copier, a printer and other image-forming apparatus. More particularly, the present invention is concerned with a sorter which sorts and collates copy sheets by use of a mechanism for driving bins sequentially toward a copy outlet of an imageforming apparatus to load them with copy sheets.

A bin driving mechanism of the king described is generally implemented with Geneva wheels each being provided with a notch, or with so-called helical cams each being provided with a helical recess therearound, and others. Such a movable bin type sorter is simpler in construction and smaller in weight than a fixed bin type sorter which includes a group of bins arranged stepwise and fixed to the body of the sorter, and deflecting means for distributing incoming copies to predetermined bins. With such advantages, a movable bin type sorter is generally suitable for use with small and medium size copiers.

For example, a prior art movable bin type sorter with a stepwise bin driving mechanism includes a group of bins each having cam members at both sides of its outermost end, and pins protruding sideways from both sides of its innermost end. The bin driving mechanism is implemented with a pair of helical cams each being provided with a helical cam therearound for engagement with the pins of the bins, the helical cams being driven by a bin drive motor. A bin unit is provided with guides in which the pins are received, the lowermost bin in the bin group being fixed to the bin unit. A bin unit biasing mechanism which is implemented with a resilient member is loaded between an upper portion of the sorter and the innermost end of the lowermost bin so as to constantly bias the bin unit upward. A bin feeding mechanism adapted to surely feed the bins step by step is provided with a pawl for catching each of the pins. Further, a sheet transporting mechanism is provided for transporting a copy sheet as the copy sheet is discharged from a copier or like image-forming apparatus to which the sorter is connected.

The prior art sorter constructed as described above has various disadvantages as enumerated below.

(1) The bin unit biasing mechanism and bin feeding mechanism which are essential add to the intricacy of construction and cost.

(2) The removal of the bins from the sorter body is not easy and, therefore, the efficiency of repair and maintenance is poor. In addition, since the bins are transported for delivery and others packed together with the sorter, they are apt to be damaged or deformed during transport and the packing work is time- and labor-consuming.

(3) To promote light-weight construction of a sorter, all of the bins except for the lowermost one are made of aluminum alloy or like material. The lowermost bin serves not only as a bin for loading copy sheets but also as the bottom plate of the bin unit and a support member for supporting the other bins. For this reason, the lowermost bin is made of a material whose sectional coefficient is greater than that of the other bins. The bins other than the lowermost one are flexed by the weight of copy sheets stacked therein until the spacing between the nearby bins, i.e., the space available above each bin decreases beyond a predetermined one. Although such seemingly lowers the stacking ability, those bins which are made of the same material undergo the same amount of flexure and, therefore, accommodate a predetermine number of copy sheets each. On the other hand, the lowermost bin having a relatively large sectional coefficient undergoes little flexure compared to the others and, therefore, cannot be provided with a space thereabove which is great enough to accommodate a predetermined number of copy sheets. In the light of this, there has been proposed an arrangement in which a support frame is provided below the lowermost bin while all the bins inclusive of the lowermost bin are made of the same material, and an arrangement in which the cam members at the outermost end of the lowermost bin are bent to a greater height than the others to define beforehand a greater space above the lowermost bin than above the others (Japanese Patent Laid-Open Publication (Kokai) No. 59-0227659). However, even such alternative schemes invite increases in size, weight and cost.

Another sorter of the type described known in the art includes means for sequentially moving a bin group step by step, and means for opening each bin to accommodate an incoming copy sheet therein and constructed independently of the opening means, as disclosed in Japanese Patent Laid-Open Publication Nos. 59-158762 and 59-158764.

Meanwhile, in a movable bin type sorter with a stepwise bin driving mechanism of the type stated, the bin driving mechanism driven by a drive motor moves a predetermined one of multiple bins to an inlet position where a copy sheet is discharged from an image-forming apparatus. To hold the particular bin at the discharge position, it is necessary for the drive motor to be braked for a moment. Means for braking the drive motor so has heretofore been implemented with a brake shoe attached to the rotor of the drive motor, or an electromagnetic brake combined with the drive motor. A problem with the brake shoe type scheme is that a predetermined brake torque is unachievable unless the motor current is increased and, in addition, the braking force is unstable. The electromagnetic brake type scheme, on the other hand, is disadvantageous in that the braking force becomes unstable in the buildup stage of the clutch, the freedom of design is limited due to the limitations on the arrangement of various parts, and the apparatus becomes bulky.

A copy sheet discharged from a copier or like imaging apparatus may be stiffened in order to ensure positive discharge, as often practiced in the art. Specifically, one-roller of each transport roller pair is provided with flanges at both sides thereof to provide a copy sheet with shallow folds each extending in an intended direction of sheet transport. In some sheet discharge mechanisms, however, a sheet discharge path is formed such that the direction of transport defined by a sheet guide member is deflected at a point just before a point of discharge, owing to the arrangement of various parts and the direction of sheet discharge which are particular to the mechanisms. In such a case, should a copy sheet be stiffened by the customary method, the paper would fail to accurately follow the deflection of the path and bend at its stiffened portions to be thereby creased or otherwise disfigured and/or produce annoying noise. For this reason, a sheet discharging mechanism having a deflected section as stated has not been furnished with stiffening means. It, therefore, has often occurred that thin sheets, sheets which are easy to gather static electricity, and the like cannot be discharged positively due to the instability of transport direction.

SUMMARY OF THE INVENTION

It is therefore an object of the present invention to solve the various problems discussed above.

it is another object of the present invention to provide a movable bin type sorter which is small size, light weight, inexpensive, easy to repair and maintain, and stable in stacking ability.

It is another object of the present invention to provide a movable bin type sorter capable of holding each bin, which has been driven stepwise, stably and economically at a position where copy sheets sequentially come in the sorter.

It is another object of the present invention to provide a sheet discharging mechanism capable of discharging even thin sheets and others positively without entailing undesirable occurrences even if a sheet transport path has a deflected portion immediately before a point of sheet discharge.

In accordance with the present invention, there is provided a sorter having a bin driving mechanism for moving a plurality of bins, which are arranged in multiple steps, sequentially and intermittently to a sheet delivery position to deliver sheets to the respective bins. The sorter comprises a bin group made up of the bins each of which is provided with pins that protrude sideways from both sides of a base end of a bottom plate of the pin. Bin support frame members support the bins such that the bins are movable individually to the sheet delivery position. The bin support frames are provided with pin guides in which the pins of the bins are slidably received.

The above and other objects, features and advantages of the present invention will become more apparent from the following detailed description taken with the accompanying drawings.

BRIEF DESCRIPTION OF THE DRAWINGS

FIG. 8A is a view of the bin unit which is so positioned as to receive a copy sheet in the first bin thereof;

FIG. 8B is a side elevation of the bit unit which is positioned as shown in FIG. 8A;

FIG. 10A is a rear view of the bin unit held in the position for receiving a copy sheet in the first bin;

FIG. 10B is a side elevation of the bin unit of FIG. 10A;

FIG. 12 is a section showing the upper guide plate which is opened by sliding its lower end up upward;

DESCRIPTION OF THE PREFERRED EMBODIMENTS

To better understand the present invention, a brief reference will be made to prior art movable bin type sorters, shown in FIGS. 1 and 2.

Figure 1:
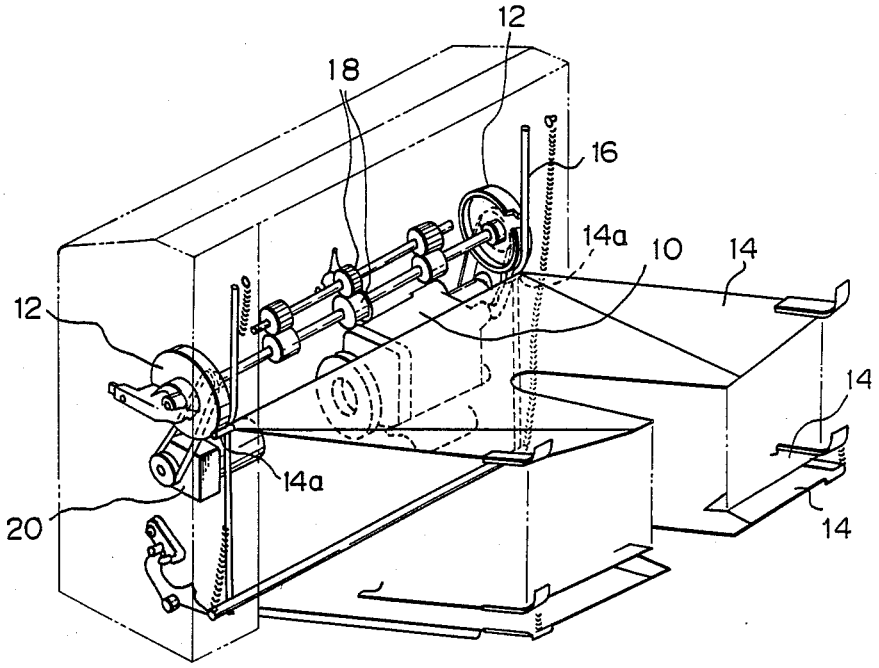
Fig. 1 PRIOR ART
FIG. 1 is a perspective view of a prior art movable bin type sorter having a stepwise bin driving mechanism which is implemented with Geneva wheels.

In FIG. 1, a prior art sorter whose bin driving mechanism is implemented with Geneva wheels and other rotatable members is shown. When a sort key, not shown, is depressed to select a sort mode, a bin drive motor 10 is driven to rotate a pair of geneva wheels 12. Then, a shaft portion **14*a* which is provided on the innermost end of a bin 14 is moved upward along bin guides 16 by the Geneva wheels 12. As the Geneva wheels 12 makes a half rotation to raise the bin 14 to a discharge region adjacent to paper feed rollers 18, the bin drive motor 10 is deenergized to hold the bin 14 in the discharge region. Then, a feed motor 20 is driven to cause the paper feed rollers 18 to deliver a copy sheet to the bin 14. Such a procedure is repeated to raise the other bins 14 sequentially and intermittently toward the discharge region. The bin drive motor 10 is energized and deenergized every time a copy sheet is delivered to one of the bins 14. Copy sheets are sequentially delivered to the bins 14, beginning at the uppermost one. When a document is replaced with another, the rotation of the bin drive motor 10 is reversed to lower the bins 14** one at a time every time a copy sheet arrives. This allows copy sheets to be fed sequentially to the bins, beginning at the lowermost one.

Figure 2:
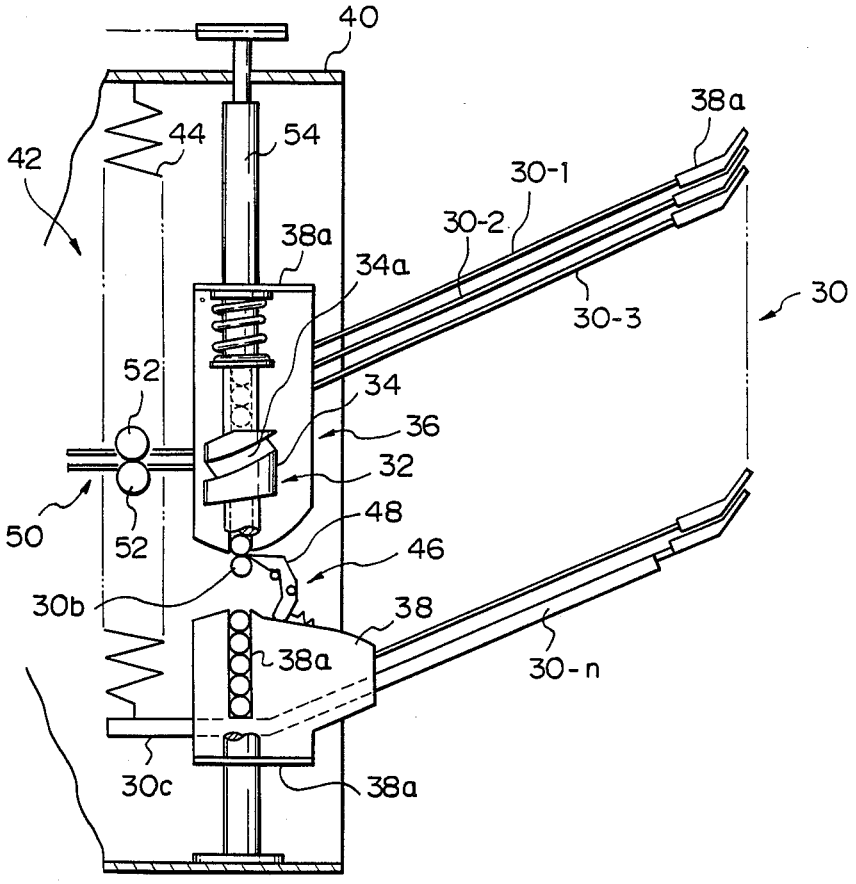
Fig. 2 PRIOR ART
FIG. 2 is a side elevation of a prior art movable bin type sorter whose bin driving mechanism is implemented with helical cams.

FIG. 2 shows another prior art movable bin type sorter whose bin driving mechanism is implemented with helical cams. Specifically, this type of sorter includes a bin group 30 made up of a plurality of bins 30-1 to 30-n each being provided with cam members **30*a* at both sides of its outermost end, and pins 30*b* protruding from both sides of its innermost end. A pair of helical cams 34, which form a part of a pin driving mechanism 32, each is provided with a helical recess 34*a* therearound for engagement with the pins 30*b* and rotated by a drive motor, not shown. The lowermost bin 30-n is fixed to a bin unit 36 which is constituted by side wall members 38 each of which is provided with a guide 38*a*. The pins 30*a* of the bins except for the bin 30-n are slidably received in the guides 38*a* of the side wall members 38. A bin unit biasing mechanism 42 is provided which comprises a resilient member 44 loaded between an upper frame 40 of the sorter and the innermost end of the lowermost bin 30-n for biasing the bin unit 38 upward. A bin feeding mechanism 46 includes a pawl 48 for catching any of the pins 30*b* and serves to surely move the respective bins step by step. Further, a sheet transporting mechanism 50 includes a roller pair 52 for transporting a copy sheet coming out from a copier or like image-forming apparatus, the sorter being connected to the imaging apparatus. Rotary shafts 54 each adapted to rotate a respective one of the helical cam 34 are slidably received in bent portions 38*a* of the side wall members 38**.

The prior art sorters shown in FIGS. 1 and 2 have the problems (1) to (3) as previously stated.

Figure 3:
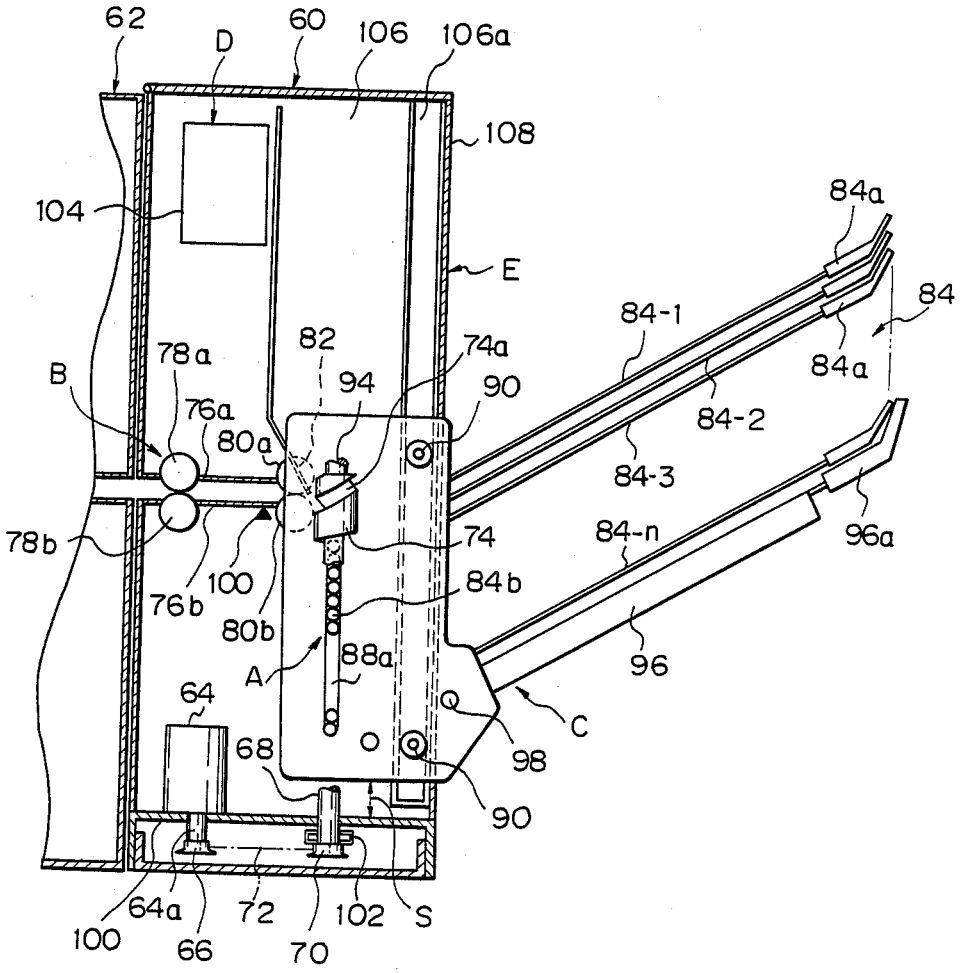
FIG. 3 is a sectional side elevation of a sorter with a stepwise bin driving mechanism embodying the present invention.
Figure 4:
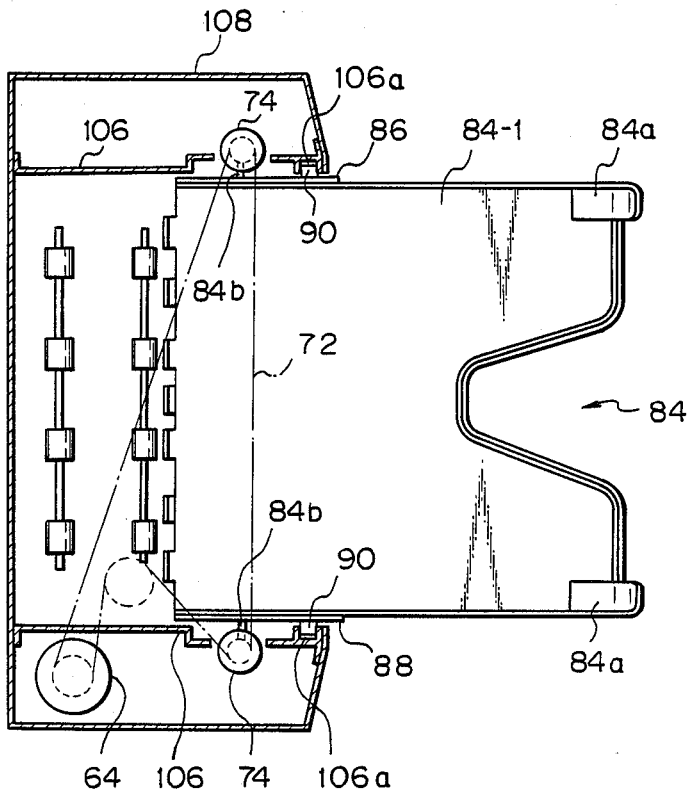
FIG. 4 is a plan view of the sorter of FIG. 3.

Referring to FIGS. 3 and 4, a sorter embodying the present invention is shown and generally designated by the reference numeral 60. As shown, the sorter generally comprises a stepwise bin driving mechanism A, a sheet transporting mechanism B for driving a copy sheet coming out from a copier 62, a bin unit C, a control section D for controlling sorting operations, and a housing E which surrounds and supports such mechanisms and units.

The bin driving mechanism A includes a drive motor 64, a timing pulley 66 mounted on the output shaft **64*a* of the drive motor 64, rotary shafts 68, timing pulleys 70 each being mounted on the lower end of a respective one of the rotary shafts 68, a timing belt 72 passed over the timing pulleys 66 and 70, and a pair of helical cams 74 each being mounted on a respective one of the rotary shafts 68 and provided with a helical groove 74*a*** therearound.

The sheet transporting mechanism B includes an upper and a lower guide plates **76*a* and 76*b*, a pair of transport rollers 78*a* and 78*b*, a pair of discharge rollers 80*a* and 80*b*, and a brush 82** for removing electrostatic charge.

Figure 5:
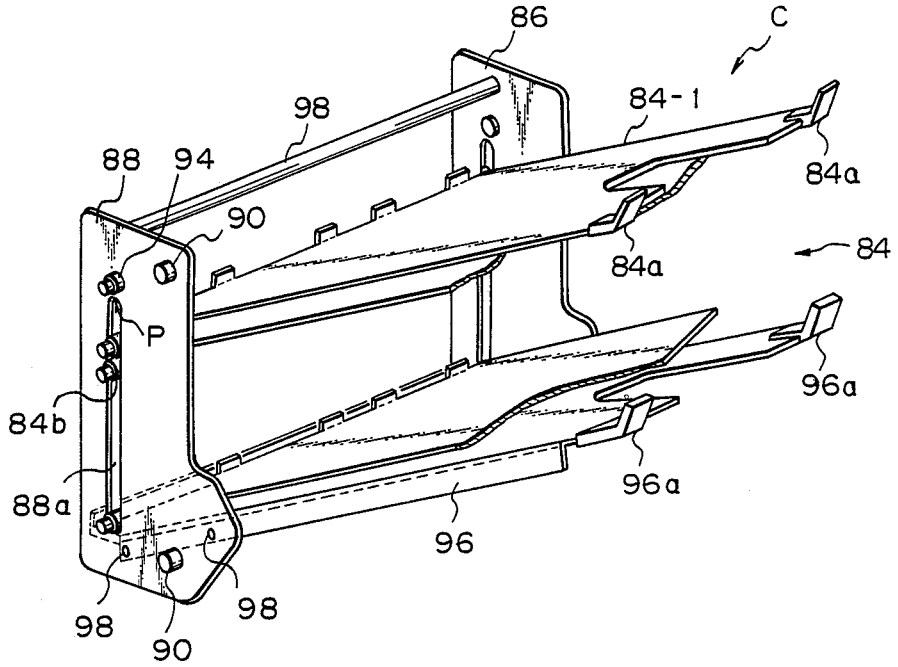
FIG. 5 is a perspective view of a bin unit which is included in the sorter of FIG. 3.
Figure 6:
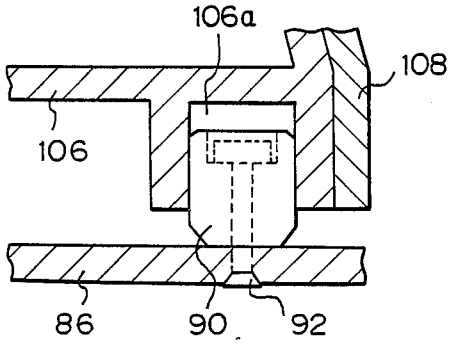
FIG. 6 is an enlarged view of a guide portion of the bin unit.

The bin unit C will be described with reference made to FIG. 5 as well. The bin unit C includes a bin group 84 made up of bins 84-1, 84-2, 84-3, . . . , 84-n each being provided with cam members **84*a* at both sides of its outermost end, and pins 84*b* protruding sideways from both sides of its innermost end. As shown in FIG. 5, each of the pins 84*b* is provided with a stepped configuration, i.e. two different diameters. Side walls 86 and 88 are provided with, respectively, bin guides 86*a* and 88*a* in which the pins 84*b* are slidably received. Unit rollers 90 are rotatably mounted on an upper and a lower portion of the outer surface of each side wall 86 or 88 by, for example, caulking 92, as shown in FIG. 6. Stop pins 94 protrude from, respectively, the outer surfaces of the side walls 86 and 88 and in alignment with the bin guides 86*a* and 88*a*. A lowermost bin 96 is provided with cam members 96*a* at both sides of its outermost end and rigidly connected at both sides of its innermost end to the inner surfaces of the side walls 86 and 88 by screws or the like. A stay 98 extends between the side walls 86 and 88** to connect them together.

The control section D includes a discharge sensor 100 located just before the discharge rollers **80*a* and 80*b* and responsive to the discharge of a copy sheet. An encoder 102 is disposed above the timing pulley 70 to sense rotations of the rotary shaft 68. A sorter controller 104 is provided for controlling the sorter 60 in response to an output of the sensor 100 and a command applied thereto from a controller of the copier 62**.

Further, the housing E of the sorter 60 includes an inner frame 106 provided with unit guides **106*a* with which the unit rollers 90 of the bin unit C are engaged, as shown in FIGS. 4 and 6. An outer frame 108 surrounds the various mechanisms and units previously mentioned. A bottom plate 110, FIG. 3, supports the sorter 60. While the bin unit C is located in a first bin discharge position (hereinafter referred to as a home position), the bottom of the bin unit C and the bottom plate 110 of the sorter outer frame 108** are spaced by a desired distance S.

Figure 7:
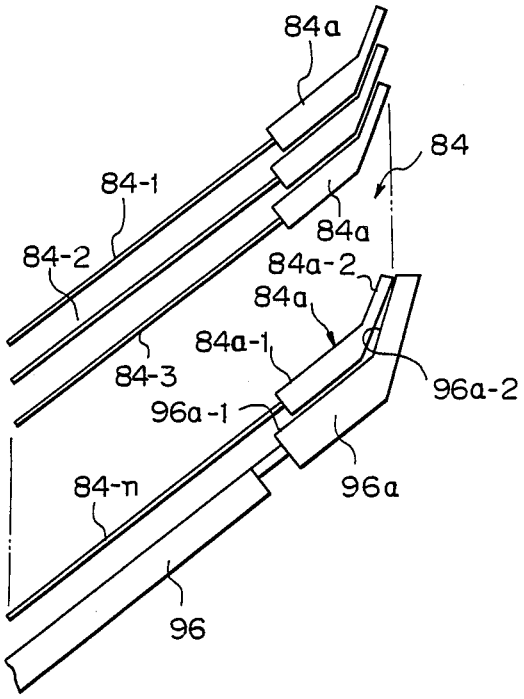
FIG. 7 is a side elevation of outermost end portions of bins.

FIG. 7 shows the bins 84-1 to 84-n and the lowermost bin 96 held in the home position. As shown, each cam member **84*a* consists of a horizontal section 84*a*-1 which extends in the same direction as the bottom plate of its associated bin 84, and an inclined section 84*a*-2 which is inclined by any suitable angle relative to the horizontal section 84*a*1. On the other hand, the cam member 96*a* of the lowermost bin 96 consists of a horizontal section 96*a*-1 which extends in the same direction as the bottom plate of the bin 96, and an inclined section 96*a*-2 which is inclined by any suitable angle relative to the horizontal section 96*a*-1 and has a greater height than the cam member 84*a* as measured from the horizontal section 96*a*-1 to the end of the inclined section 96*a*-2**.

The sorter 60 having the above construction is operated as follows.

Assume that the operator has selected a particular mode in which a plurality of original documents are treated as one copy, the operation for producing copy sheets of one copy of original documents constitutes one cycle, and this cycle is repeated for sorting by the number of times which is equal to the number of desired copies, i.e. a sort mode. While the sorter 60 is not operated, the bin unit C is maintained in the home position. In this condition, all of the pins **84*b* are located below the lower ends of helical cams 74 within the bin guides 86*a* and 88*a*. Each stop pin 94 is partly or entirely engaged in the helical groove 74*a* of its associated helical cam 74**.

In FIG. 3, on start of operation of the copier 62, the first copy sheet associated with the first document is transferred from the copier 62 to the sorter 60. This copy sheet is transported through the upper and lower guide plates **76*a* and 76*b* by the transport rollers 78*a* and 78*b* and, then, driven by the discharge rollers 80*a* and 80*b* onto the first bin 84-1. At this instant, the brush 82 serves to remove electrostatic charge from the copy sheet. The discharge sensor 100** senses the copy sheet discharged, and its output is fed via the sorter controller 104 to a controller of the copier 62, not shown, to be counted by the latter. As the discharge of the copy sheet is sensed by the discharge sensor 100, the sorter controller 104 delivers a drive signal to the drive motor 64.

Driven by the drive signal, the drive motor 64 causes the shafts 68 and helical cams 74 into rotation through the timing belt 72. The stop pins 94 received in the helical grooves 74*a* of the individual helical cams 74 are moved upward along the grooves 74*a* resulting that the bin unit C is bodily moved upward along the unit guides 104*a* through the unit rollers 90. Specifically, the unit rollers 90 guide the entire bin unit C along the unit guides 106*a* while sliding and rolling within the unit guides 106*a*. While the bin unit C is raised, each pin 84*b* of the first bin 84-1 is caused to abut against the lower end of its associated helical cam 74 and, then, received in a notched portion of the helical groove 74*a*. The pins 84*b* are moved along the helical grooves 74*a* so that the first bin 84-1 is pushed out in the intended direction of sheet discharge (see FIG. 9).

Figure 9:
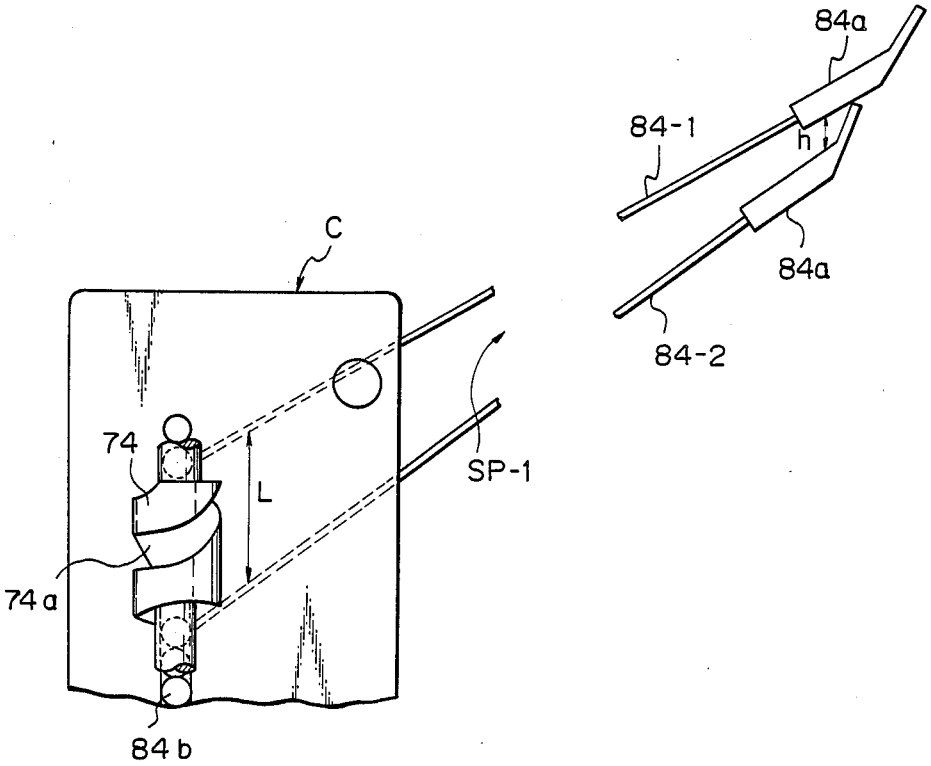
FIG. 9 is a side elevation of the bin unit held in a position for receiving a copy sheet in the second bin.

When the pins 84*b* of the first bin 84-1 become protruded from the upper ends of the individual helical cams 74, the upper portions of the pins 84*b* are brought into contact with the upper ends P, FIG. 5, of the individual pin guides 106*a*. When the number of rotations of the shaft 68 reaches a predetermined one as sensed by the encoder 102, the sorter controller 104 deenergizes the drive motor 64 to stop the rotation of the helical cams 74. The pins 84*b* of the first bin 84-1 continuously rises while pushing the upper ends P of the pin guides 106*a*, until the helical cams 74 have been stopped, i.e., until the pins 84*b* themselves have been entirely pushed out beyond the upper ends of the helical cams 74. Hence, the entire bin unit C is brought to a halt after being urged upward by a distance which is equal to the diameter of the pins 84*b* (see FIGS. 10A and 10B). As shown in FIG. 9, the first bin 84-1 in the above condition is spaced from the second pin 84-2 by a distance SP-1 which is great enough to load the second bin 84-2 with a predetermined amount of copy sheets; the distance SP-1 being L which is equal to the height of each helical cam 74 at the bin innermost end, and h which is equal to the height of each cam member 84*a* at the bin outermost end.

Subsequently, the second copy sheet of the first document is delivered to the second bin 84-2. On completion of the delivery to the second bin 84-2, the pins 84*b* of the second bin 84-2 are raised along the helical grooves 74*a* of the individual helical cams 74 to abut against and raise the pins 84*b* of the first bin 84-1, which are held in contact with the upper ends of the helical cams 74. Every time the helical cams 74 complete one rotation, the above procedure is repeated to raise the successive bins step by step while, at the same time, the bin unit C is raised along the unit guides 106*a* by each amount which is equal to the diameter of the pins 84*a*.

When the copying operation with the first original document has been repeated by the number of times equal to the desired number of copies, an end-of-copy signal is fed from the controller of the copier 62 to the sorter controller 104. As the discharge sensor 100 senses the delivery of the last copy sheet, the sorter controller 104 applies a reverse signal to the drive motor 64 to rotate it in the reverse direction. This causes the helical cams 74 to rotate in the opposite direction to the direction in which they were rotated during upward movement. The pins 84*b* are brought into pressing contact with the upper ends of the helical cams 74 by gravity and lowered along the helical grooves 74*a* while, at the same time, the bin unit C is bodily lowered along the unit guides 106*a*. As the bin unit C is lowered by the same amount as that of the previous upward movement as determined by the encoder 102, which senses the rotations of the shaft 68, the sorter controller 104 deenergizes the drive motor 64 to settle the pin unit C at the home position. When a home position sensor or the like, not shown, senses the return of the bin unit C to the home position, the copier 62 starts on another repetitive copying operation with the next original document. The resulting copy sheets are sorted by the previously stated procedure. The sequence of steps described above are repeated until the last document has been reached.

It is to be noted that the present invention may also be practiced in another mode in which a predetermined number of copy sheets are produced on a document-by-document basis, then such a copying operation is repeated for all of the documents, and then the resulting document sheets are sorted, i.e. a stack mode. A stack mode has customarily been used in combination with the previously stated sort mode.

Even if the home position to which the bin unit C is restored is somewhat deviated from the regular home position, the stop pins 94 prevent the sorting operation from being disturbed. Nevertheless, should the stop pins 94 be lowered beyond a normal level to slip off the helical grooves 74*a* of the helical cams 74, the sorter 60 would become inoperable. In the light of this, the sorter 60 is provided with a position sensor, not shown, which is located at a suitable position in such a manner as to deenergize the drive motor 64 when sensed any unusual downward movement of the bin unit C. Another possible implementation against the unusual downward movement of the bin unit C is providing a stop at a suitable position in each unit guide 106*a* so as to stop the unit roller 90.

A prerequisite with the embodiment shown and described is that the maximum distance of opening between the stop pins 94 and their associated pins 84*b* of the first bin 84-1 be smaller than the height L of the helical cams 74. Should the distance mentioned above be greater than the dimension L, the pins 84*b* would fail to abut against the lower ends of the helical cams 74 preventing the bin group 84 from being driven.

If desired, an exclusive stop member may be used to stop the bin unit C at the home position.

As stated above, each pin guide 88*a* has the upper end P which is engageable with the pin 84*b*, and the upper end of the pin guide 106*a* reaches the same level as that of the upper end of the helical cam 74 when the bin unit C is in the home position or when the lower portion of the stop bin 94 is in contact with the upper end of the helical cam 74. This allows the bin unit C to be moved up and down by the rotation of the helical cams 74 only, thereby promoting the simplicity of construction.

The unit guides 106*c* adapted to guide the bin unit C extends as far as the upper end of the sorter 60 and is open and, in addition, nothing which would interfere with the movement of the bin unit C exists above the sorter 60. Hence, the bin unit C can be readily mounted to and dismounted from the housing of the sorter 60.

Further, since all of the bins are provided as a part of the bin unit C, it is needless for the bins to be removed one by one. Such further enhances efficient manipulation in the event of repair, inspection and packing of the sorter 60. In addition, since the previously mentioned spacing S is ensured even if the bin unit C is moved to its lowermost position, or home position, a person is prevented from having his or her fingers caught between the bin unit C and the upper surface of the bottom plate.

Figure 11:
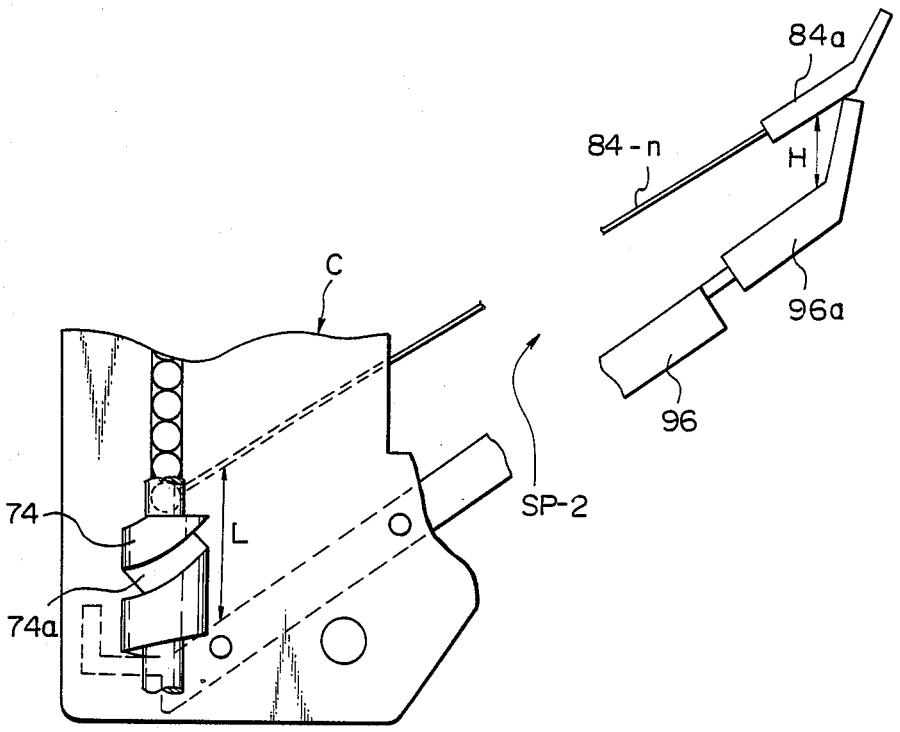
FIG. 11 is a side elevation of the bin unit brought to a position for receiving a copy sheet in the lowermost bin.

A reference will be made to FIGS. 5 and 11 for explaining a space which is defined above the lowermost bin 96. When a copy sheet is to be delivered to the lowermost bin 96 after copy sheets have been sequentially stacked on the other bins 84, a space SP-2 for accommodating a stack of copy sheets is defined above the lowermost bin 96 through the previously stated process. The space SP-2 has a height L at its innermost end which is equal to the height of the helical cams 74, and a height H at its outermost end which is equal to the height of the cam members 96*a*. The cams 96*a* of the lowermost bin 96 are configured relative to the cams 84*a* of the bin group 84 such that the dimension H is greater than the dimension h. In this condition, the space SP-2 above the lowermost bin 96 remains greater than the space SP-1 above each bin of the bin group 84 even if the bin right above the bin 96 is flexed due to the weight of copy sheets loaded thereon.

It is to be noted that this embodiment is not limited to a sorter of the type using helical cams and may alternatively be applied to a sorter of the type using Geneva wheels.

Further, the outermost end of each bin may be provided with a hemispherical, a rectangular parallelpiped or like configuration so as to define a space of adequate height above the bin.

Figure 12:
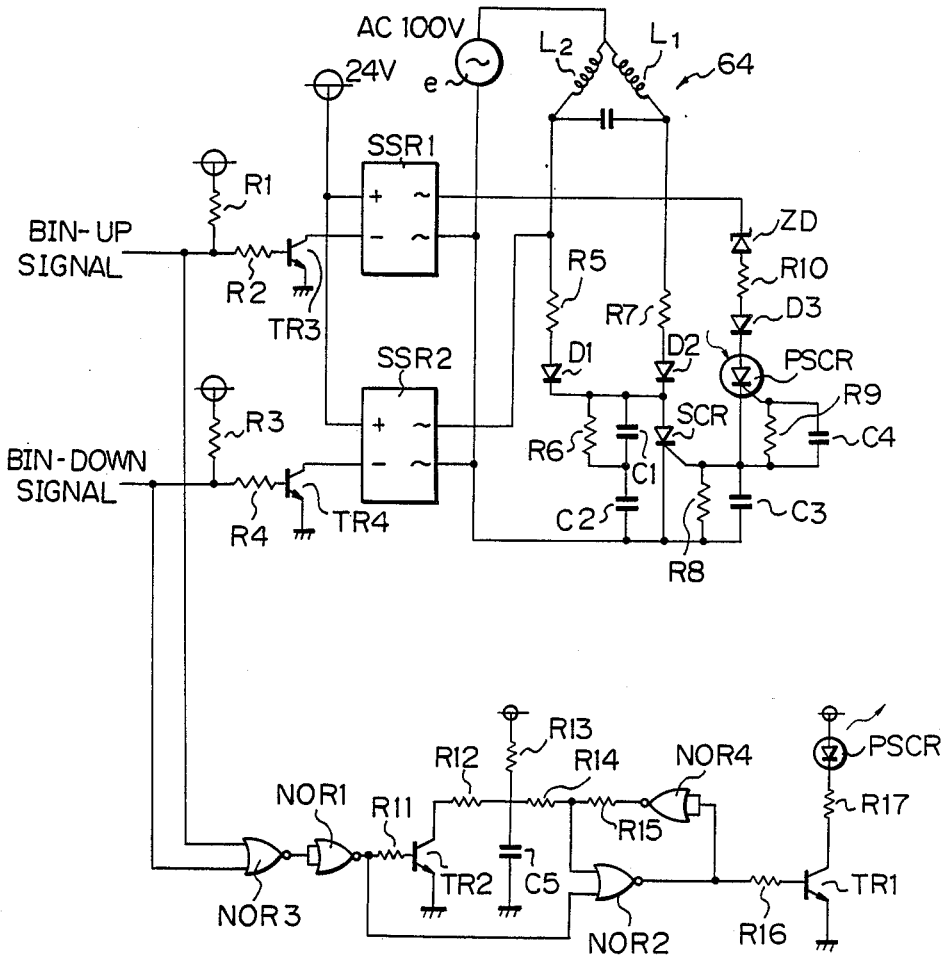
FIG. 12 is a diagram showing a control circuit for controlling the stop of rotation of a bin drive motor.

Referring to FIG. 12, a control circuit installed in the sorter 60 for controlling the bin drive motor 64 is shown. The bin drive motor 64 is implemented with an AC reversible motor. In FIG. 12, there are shown windings L1 and L2 of the bin drive motor 64, solid state relays SSR1 and SSR2, a thyristor SCR, a photothyristor PSCR, diodes D1 to D3, an AC power source e, capacitors C1 to C5, NOR gates NO1 to NOR4, transistors TR1 to TR4, resistors R1 to R17, and a Zener diode ZD.

Figure 13:
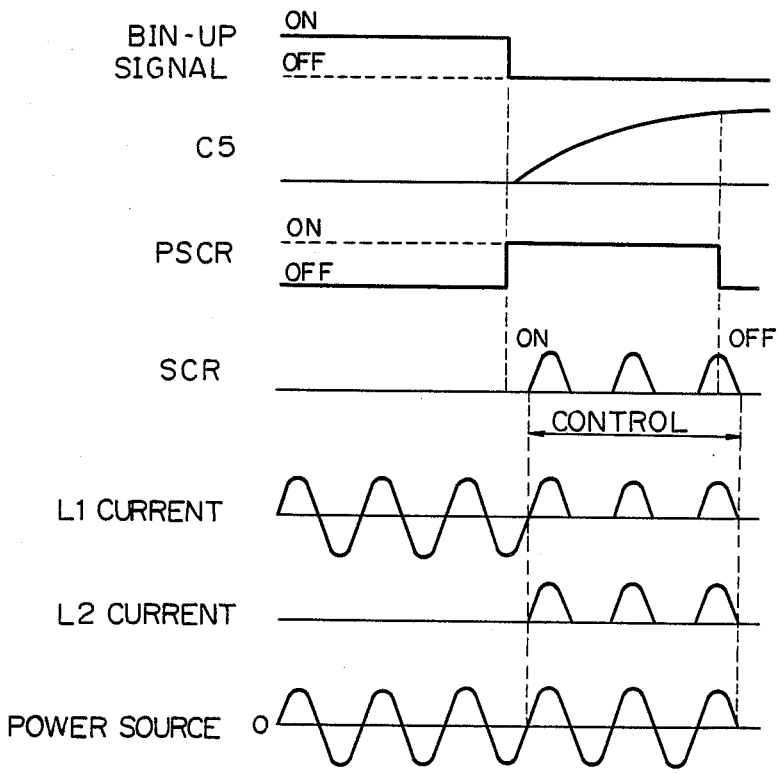
FIG. 13 is a timing chart demonstrating the operation of the control circuit as shown in FIG. 12.

FIG. 13 is a timing chart demonstrating the operation of the control circuit. When a bin-up signal is turned into an onstate, it renders the transistor TR3 conductive to thereby energize the solid state relay SSR1. This causes the AC power source e to power the bin drive motor 64 via the solid state relay SSR1, whereby the motor 64 is rotated forward to raise the bins. At this instant, the output of the NOR gate NOR3 is low level (L) to make the output of the NOR 1 high level (H), resulting that the transistor TR2 is turned on to short-circuit the capacitor C5. This turns the output of the NOR gate NOR2 into L to render the transistor TR1 non-conductive and, thereby, turns off the photothyristor PSCR and thyristor SCR.

As the bin-up signal is caused into an off-stated, the transistor TR3 is rendered non-conductive to deenergize the solid state relay SSR1 and, at the same time, the output of the NOR gate NOR3 is turned into H to in turn make the output of the NOR gate NOR1 L. As a result, the transistor TR2 is turned off to cause the capacitor C5 to be charged by the power source via the resistor R13 while, at the same time, turning the output of the NOR gate NOR2 into H to thereby turn on the transistor TR1. Hence, the thyristor SCR is turned on at a level at which the output of the AC power source e becomes zero with the photothyristor PSCR turned on. Then, the output of the AC power source e is rectified by the diodes D1 and D2 so that braking current is applied to the windings L1 and L2 of the motor 64, whereby an electromagnetic force for stopping the rotation of the motor 64 is generated to brake the motor 64.

As the capacitor C5 is charged up to a predetermined voltage, i.e., as a predetermined period of time expires since the bin-up signal has been turned off, the output of the NOR gate NOR2 becomes L. Then, the transistor TR1 and, therefore, the photothyristor PSCR is turned off so that, at the instant when the output of the AC power source e becomes zero, the thyristor SCR is deenergized. Consequently, the application of the braking current to the motor 64 is terminated to stop the rotation of the motor 64.

When a bin-down signal is turned into an on-state, it renders the transistor TR4 conductive to energize the solid state relay SSR2. Then, the output of the AC power source e is applied to the motor 64 to drive it in the reverse direction via the solid state relay SSR2, whereby the bins are lowered. The capacitor C5 is short-circuited by the transistor TR2, as has been the case with the on-state of the bin-up signal. In response, the transistor TR1, photothyristor PSCR and thyristor SCR are turned off. As the bin-down signal becomes off, it turns off the transistor TR4 and, thereby, the solid-state relay SSR2 resulting that the output of the NOR gate NOR3 becomes H. As a result, braking current is applied to the motor 64 for a predetermined period of time to stop the motor 64, as in the case with the turn-off of the bin-up signal.

The control circuit adapted to electrically brake the bin drive motor 64 as described above is capable of applying a stable braking force to the motor 64 surely and economically. In addition, such a control circuit eliminates the need for a bulky braking means heretofore used and, thereby, simplifies the construction of the apparatus while promoting miniaturization of the apparatus.

Hereinafter will be described another embodiment of the sheet transporting mechanism B of the sorter.

Figure 14:
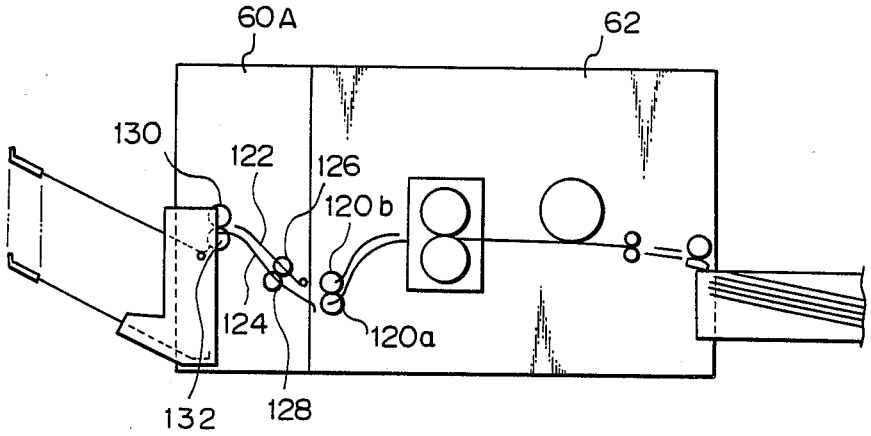
FIG. 14 is a section showing a sorter to which a sheet transporting mechanism in accordance with the present invention is applied, the sorter being mounted on a copier.
Figure 15:
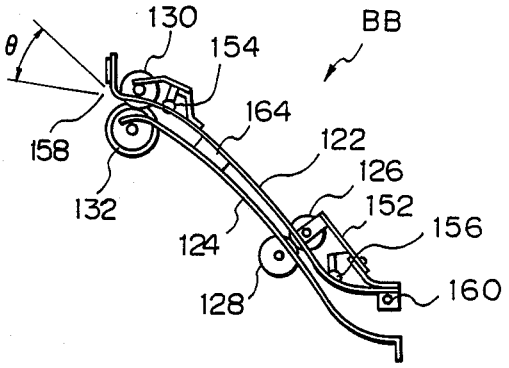
FIG. 15 is a section showing the construction of the sheet transporting mechanism.
Figure 16:
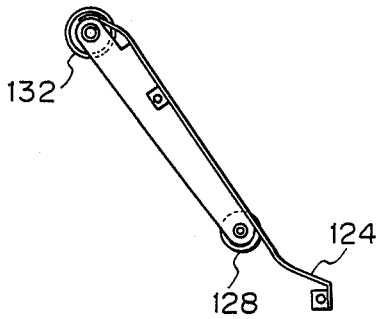
FIG. 16 is a side elevation showing a lower guide plate included in the sheet transporting mechanism together with rollers mounted on the lower guide plate.
Figure 17:
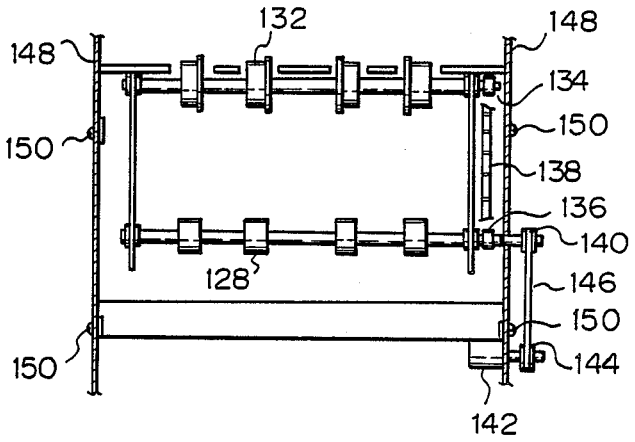
FIG. 17 is a plan view of the lower guide plate and rollers.

Referring to FIG. 14, there is shown a sorter 60A with a sheet transporting mechanism in accordance with this particular embodiment, the sorter 60A being mounted on the copier 62. A copy sheet driven a discharge roller pair 120*a* and 120*b* out of the copier 62 is introduced into a sheet transporting mechanism BB which is installed in the sorter 60A. As shown in FIG. 15, the sheet transporting mechanism BB comprises an upper and a lower guide plate 122 and 124, an inlet roller pair 126 and 128, and an outlet roller pair 130 and 132. As shown in FIGS. 16 and 17, the rollers 132 and 128 which serves as drive rollers are rotatably supported by side panels below the lower guide plate 124. Pulleys 134 and 136 are mounted on, respectively, one end of the shafts on which the drive rollers 132 and 128 are mounted. A toothed belt 138 is passed over the pulleys 134 and 136. Further, pulleys 140 and 144 are mounted on, respectively, the extreme end of the shaft of the rollers 128 and that of a drive motor 142. Passed over the pulleys 140 and 144 is a round belt 146. In this configuration, the rollers 128 and 132 are rotatable at the same time and in the same direction. As shown in FIG. 17, the unit including the lower guide plate 124 is fixed in place by screws 150 which are driven from both sides into side panels 148 of the sorter 60.

Figure 18:
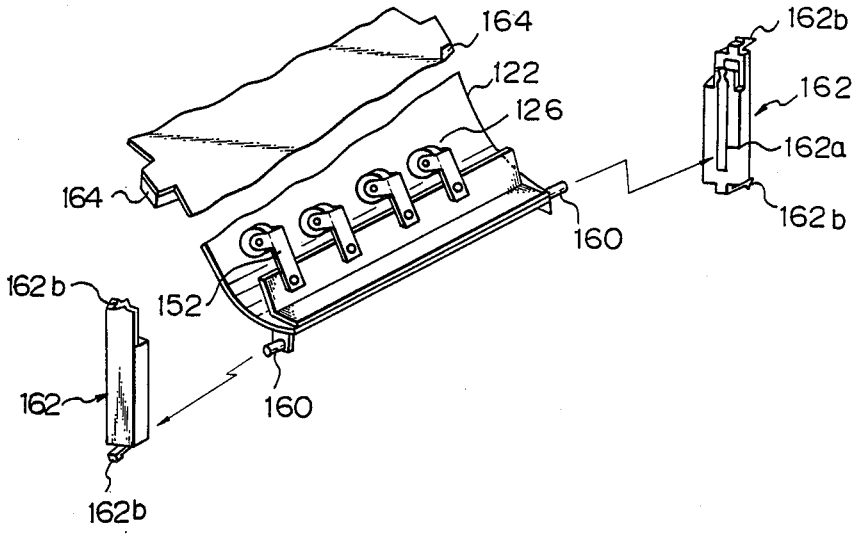
FIG. 18 is an exploded perspective view of a part of an upper guide plate also included in the sheet transporting mechanism.

As shown in FIGS. 15 and 18, each of the rollers 130 and 126 which are driven rollers is mounted to the upper guide plate 122 through a leaf spring 152. The rollers 130 and 126 are held in pressing engagement with and driven by the drive rollers 132 and 138, respectively, Further, guide rollers 154 and 156 are mounted on the upper guide plate 122 to prevent a copy sheet, which is transported in a warped condition with its upper surface (image surface) facing upward, from having the image surface rubbed. As shown in FIG. 15, a brush 158 is located immediately after the discharge roller pair 130 and 132 so as to remove electrostatic charge from an incoming copy sheet.

Figure 19:
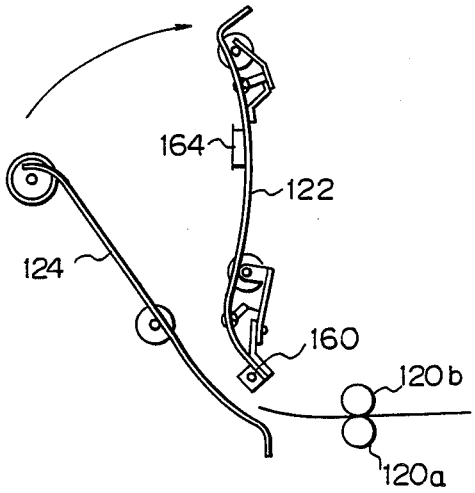
FIG. 19 is a section showing the upper guide plate rotated about its lower end to an open position.
Figure 20:
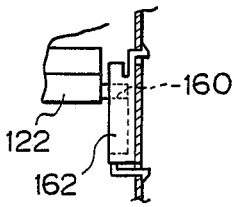
FIG. 20 is a front view of a member adapted to allow the lower end of the upper guide plate to slide up and down.
Figure 21:
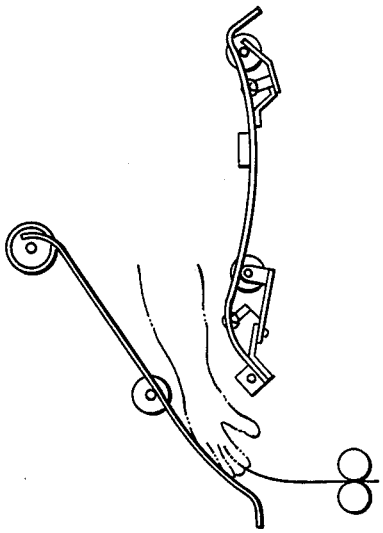

The upper guide plate 122 is pivotted to the side panels of the sorter 60A through pins 160 which are studded on both sides of the lower end of the guide panel 122. As shown in FIG. 19, the upper guide plate 122 is rotatable about the pins 160 away from the lower guide plate 124 to an open position. However, assuming that a copy paper has jammed in a transfer position between the discharge rollers 120*a* and 120*b* of the copier 62 and the sorter 60A, the narrow opening defined at the lower end of the lower guide plate 124 as shown in FIG. 19 would make it impossible for the paper to be removed. In the light of this, as shown in FIGS. 18 and 20, guide plate supports 162 each having a perpendicularly extending elongate slot 162*a* are mounted to both side panels of the sorter 60A through pawls 162*b*. The pins 160 at the lower end of the upper guide plate 22 are individually slidably mated with the slots 162*a* of the guide plates supports 162. In such a construction, when a copy sheet has jammed in the above-mentioned position between the copier 62 and the sorter 60A, as shown in FIGS. 20 and 21, the pins 160 of the upper guide plate 122 may be moved upward along the slots 162*a* to define an opening between the lower ends of the upper and lower guide plates 122 and 124 which is large enough to insert the hand for removing the copy sheet.

In this particular embodiment, as shown in FIG. 15, the path along which a copy sheet is guided by the upper guide plate 122 is deflected by an angle of $\theta$ at a position immediately before the discharge section. In such a configuration, while a prior art mechanism is not furnished with an implementation for stiffening a copy sheet, the mechanism BB in accordance with this particular embodiment is provided with means for stiffening a copy sheet to allow it to be transported with ease along the deflected path.

Figure 22:
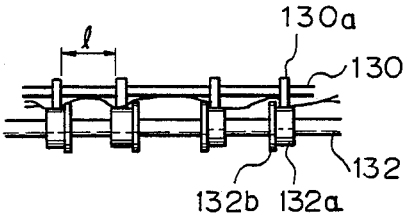
FIG. 22 is a fragmentary front view of an outlet roller pair which is provided with stiffening means.
Figure 23:
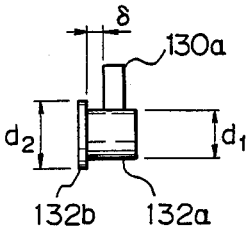
FIG. 23 is an enlarged front view of a part of the outlet roller pair.

Specifically, as shown in FIG. 22, a flange 132*b* is fitted on one end of each of rollers 132*a* which are rigidly mounted on the shaft of the drive roller 132, which constitutes the mechanism BB in cooperation with the driven roller 130. An exemplary configuration of the rollers 132*a* and flanges 132*b* is shown in detail in FIG. 23. The rollers 132*a* associated with the drive roller 132 are made of a polyurethane- or chloroprene-based foamed material whose hardness is 45. As shown in FIG. 23, each roller 132 includes a portion having a diameter $d_1$ with which the roller 130*a* of the driven roller 130 makes contact. The flange 132*b* provided on one end and integrally with the roller 132*a* has a diameter $d_2$ which is 1 to 2 millimeters greater than the diameter $d_1$. The facing surfaces of the driven roller 130*a* and flange 132*b* should preferably be spaced from each other by a distance $\delta$ which is 2 to 5 millimeters. Further, the rollers should preferably be arranged at a pitch l which is 50 to 100 millimeters. These specific numerical values are the results of experiments which were conducted by selecting a deflection angle $\theta$ of $55° \pm 10°$ and using sheets whose weight was 40 to 90 grams per square meter. Naturally, those numerical values will be changed with a change of such conditions.

Figure 24:
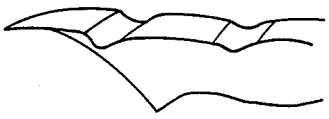
Fig. 24 PRIOR ART
FIG. 24 is a perspective view of a sheet which is folded by prior art stiffening means.
Figure 25:
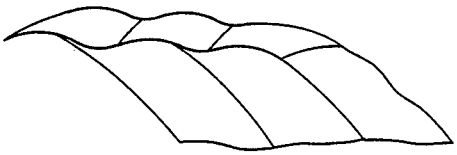
FIG. 25 is a perspective view of a sheet which is folded by a sheet transporting mechanism in accordance with the present invention.

FIG. 24 shows a sheet which was stiffened by a prior art arrangement wherein each roller is provided with flanges at both sides thereof, the sheet being locally folded in a groove-like configuration. FIG. 25 shows a sheet which was stiffened by the drive rollers 132 each having a flange at one side thereof only and the driven rollers 130. The sheet shown in FIG. 25 is smoothly rounded out with a relatively large radius of curvature between the nearby folds and, therefore, it is capable of following the deflection of the path smoothly despite the stiffness. Such prevents the sheet from being bent or otherwise damaged or producing annoying sound. The arrangement of FIG. 22 in which all of the flanges 132*b* are provided on those ends of the rollers 132*a* which face the center with respect to the width of a sheet is desirably applicable to a case wherein the center line is adopted as a reference for sheet transport; various alternative arrangements are available such as a one wherein all of the flanges are provided on the same sides of the rollers so as to cope with a reference for sheet transport which is implemented with one side of the width of a sheet.

The transport speed of a sorter is generally greater than the discharge speed of a copier in order to provide a substantial distance between copy sheets, which sequentially come in the sorter, and to prevent the rear end of a copy sheet from being left non-discharged. In this situation, the copier and the sorter undesirably pull a copy sheet toward each other and, in the light of this, it has been customary to implement the transport rollers of the sorter with sponge rollers and others whose coefficient of friction or pressing force is small enough to slip on a copy sheet. This prior art implementation is not fully acceptable because a substantial degree of tension acting on a copy sheet causes an upper guide plate to be raised by a copy sheet depending on the position of a sheet discharging device in the sorter, disenabling accurate transport of a copy sheet. To solve this problem, as shown in FIGS. 15, 18 and 19, a magnet 154 may be mounted on the upper guide plate 122 or the lower guide plate 124 so as to attract the other guide plate. This ensures a constant clearance between the upper and lower guide plates 122 and 124 and, thereby, accurate transport of a copy sheet without the fear of bending of the sheet and other occurrences.

As described above, a copy sheet can be fed out positively despite the simple construction and even if a sheet discharge path is deflected at a position just before the point of discharge.

Various modifications will become possible for those skilled in the art after receiving the teachings of the present disclosure without departing from the scope thereof.

What is claimed is:

1. A sorter having a helical cam bin driving mechanism for moving a plurality of bins, which are arranged in multiple steps stacked one upon another sequentially and intermittently to a sheet delivery position to deliver sheets to each of said respective bins, said sorter comprising:

a bin group made up of said bins, each of said bins being provided with pins which protrude sideways from both sides of a base end of a bottom plate of said pin and aligned so as to be engaged by said helical cam;

bin support frame members for supporting the bins such that said bins are movable individually to the sheet delivery position, said bin support frame members being provided with pin guides in which the pins of said bins are slidably received wherein said bin support frame members includes a pair of side plates which face each other, the pin guides having elongate slots each being formed through a respective one of said side plates, each of said elongate slots having an abutment at an upper end thereof for engagement with the pins and wherein said plates having means fixedly attached thereto so as to fix each side plate to each other at the top and bottom thereof such that said bins are disposed therebetween; and a drive means for driving said helical cam of said bin driving mechanism including an AC reversible motor, and a motor stop control circuit for, while said AC reversible motor is deenergized, rectifying an AC power source to apply braking current to said motor over a predetermined period of time.

2. A sorter as claimed in claim 1, further comprising an outer frame constituting a housing of said sorter, an inner frame surrounding the bin group and bin support frame members and having guides for guiding said support frame members movably, said side plates being provided with rotatable rollers each being guided by a respective one of said guides of said inner frame.

3. A sorter as claimed in claim 1, wherein each of the bins of the bin group comprises:

cam members provided at both sides of a free end of said bin, each of said cam members consisting of a horizontal section extending in a same direction as the bottom plate of each of said bins, and an inclined section inclined relative to said horizontal section.

4. A sorter as claimed in claim 3, wherein the inclined section of each cam member of a lowermost one of the bins has a greater height than the inclined sections of the other bins.

5. A sorter as claimed in claim 4, wherein while said sorter is not in a sort mode, spaces available above the individual bins for receiving sheets are equal to each other and, while said sorter is in a sort mode, said space available above the lowermost bin becomes greater than said spaces available above the other bins.

6. A sorter as claimed in claim 1, further comprising a sheet transporting mechanism for transporting a sheet coming out from an apparatus, to which said sorter is connected, to the delivery position, said sheet transporting mechanism comprising an upper and a lower guide plates and a pair of transport rollers having drive rollers and driven rollers which are held in pressing contact with and driven by said drive rollers, each of said drive rollers being provided at one end thereof with a flange which is greater in diameter than that portion of said drive roller which makes contact with said driven roller associated with said drive roller.

* * * * *